US009061190B2

(12) United States Patent
Willardson

(10) Patent No.: US 9,061,190 B2
(45) Date of Patent: Jun. 23, 2015

(54) BASEBALL SWING TRAINING APPARATUS

(71) Applicant: David Willardson, Katy, TX (US)

(72) Inventor: David Willardson, Katy, TX (US)

( * ) Notice: Subject to any disclaimer, the term of this patent is extended or adjusted under 35 U.S.C. 154(b) by 0 days.

(21) Appl. No.: 14/052,744

(22) Filed: Oct. 13, 2013

(65) Prior Publication Data

US 2015/0105187 A1 Apr. 16, 2015

(51) Int. Cl.
*A63B 69/00* (2006.01)

(52) U.S. Cl.
CPC ..... *A63B 69/0002* (2013.01); *A63B 2069/0008* (2013.01); *A63B 69/0075* (2013.01)

(58) Field of Classification Search
CPC ..... A63B 69/0075; A63B 69/002
USPC ..... 473/417, 422, 453, 279, 247, 187, 272, 473/429, 461; 482/136, 117
See application file for complete search history.

(56) References Cited

U.S. PATENT DOCUMENTS 3,439,916 A * 4/1969 Kopp ..... 473/419
5,275,396 A * 1/1994 Sudia ..... 473/427
5,478,070 A * 12/1995 Morrison ..... 473/419
5,679,082 A * 10/1997 Hincke ..... 473/588
5,897,444 A * 4/1999 Hellyer ..... 473/417
6,435,990 B1 * 8/2002 Bradley ..... 473/453
7,811,183 B1 * 10/2010 Ohle ..... 473/429
2007/0167262 A1 * 7/2007 Lortscher ..... 473/417
2008/0248900 A1 * 10/2008 Hernandez ..... 473/453

* cited by examiner

*Primary Examiner* — Gene Kim
*Assistant Examiner* — Rayshun K Peng
(74) *Attorney, Agent, or Firm* — Gulf Coast Intellectual Property Group

(57) ABSTRACT

A baseball swing training device that is operable to teach an improved baseball swing plane wherein the baseball swing training device is tiltably adjustable in a first direction and a second direction. The baseball swing training device further includes a base member having a telescoping support arm extending upward therefrom. Secured to the telescoping support arm is an upper frame assembly that includes a support arm that is u-shaped. An upper bat guide member and a lower bat guide member are secured to the support arm and are parallel in configuration having a void therebetween. A pair of ball grip members are mounted intermediate the lower bat guide member and upper bat guide member. A speed sensor is present and is operable to detect the speed of either the ball or the bat during use of the baseball swing trainer and display the speed on a LCD screen.

10 Claims, 5 Drawing Sheets

BASEBALL SWING TRAINING APPARATUS

PRIORITY UNDER 35 U.S.C SECTION 119(E) & 37 C.F.R. SECTION 1.78

This nonprovisional application claims priority based upon the following prior U.S. Provisional Patent Application entitled: Baseball and Softball Swing Training Device and Method, Application No. 61/815,427, filed Apr. 24, 2013, in the name of David Willardson, which is hereby incorporated by reference for all purposes.

FIELD OF THE INVENTION

The present invention relates to a sports training apparatus, more specifically but not by way of limitation, a swing training device operable to improve the swing of a user for sports such as but not limited to baseball and softball wherein the device utilizes a dual axial movement to improve a user's swing.

BACKGROUND

Millions of recreational athletes participate in sports on a regular basis. Sports participation not only helps the physical development of youth but also teaches important skills such as teamwork. Among the numerous sports that youths engage in, baseball and softball are among the most popular. Many children begin learning the play baseball and/or softball at a very early age. As the children begin to learn the game they learn the skills required for various positions such as learning to throw and catch. Another skill that must be taught is hitting. Learning the correct swing technique is a very important skill for players of all ages.

Hitting a baseball or softball is exceptionally difficult. Ted Williams, arguably the greatest baseball hitter of all-time once said "I think without question the hardest single thing to do in sport is to hit a baseball". A key principle that Mr. Williams noted in his book "The Science of Hitting" is the importance of swinging the bat on the plane of the incoming pitch and increasing the area of solid contact.

Mathematically, compound angles could be calculated for a swing plane that maximizes the area of opportunity for bat-ball contact, commonly referred to as "the hitting zone" given the path and location of an incoming pitch. Consequently, the three points establishing the optimal plane are the point at which the ball enters the hitting zone, the point the ball leaves the hitting zone, if it were not contacted, and the hitter's spine at the height of the shoulders. The spinal point is a relatively a fixed plane point location as the kinetic chain of energy is sequentially transferred from the lower to upper body and ultimately through the shoulders to the bat and ball.

Batting success varies significantly based on the type of hit by the batter. Batting averages on balls hit into the field of play for line drives are approximately 2-4 times more likely to result in a successful hit versus ground balls or fly balls that remain in the field of play. Coincidentally, but very importantly, the launch angle of the ball required for a successful line drive hit is very similar to the plane of an incoming pitch. Thus, by having an effective swing plane, the batter not only improves the odds of solid contact but also improves the odds of the most effective type of hit.

In training to improve hitting skill, players can benefit from immediate feedback to determine if they are swinging on the correct plane and how hard they are hitting the ball as measured through either ball speed or bat speed. If a player changes the plane throughout the swing, angular velocity decreases thereby reducing batted ball speed. By practicing with feedback, players are able to associate specific mechanics that result in more consistent and effective swing paths and faster bat and ball velocities.

One problem with existing technology in swing training devices is that existing devices do not train users how to swing using the most effective swing plane. Analysis of an improved baseball swing shows that an effective plane of a baseball swing is in a slightly upward direction, which is more axially aligned with the flight path of an incoming pitch. Additionally, an improved swing maintains a consistent plane around a relatively consistent axis (i.e. swinger's spine) that is tilted slightly rearward (towards tan exemplary catcher) as well as forward (over the feet). Existing swing trainers utilize elements and methods that are operable to teach a method of swinging a bat, which results in a generally level bat at contact with a ball. This is a less desirable bat plane position as the force required to maintain the substantially level angle of the bat results in a reduced force being applied to the ball at impact.

Accordingly, there is a need for a baseball and/or softball swing training device that provides a dual axis adjustment that is operable to teach a swing plane that produces a more effective and powerful swing and provides immediate feedback to the user to accelerate improvement.

SUMMARY OF THE INVENTION

It is the object of the present invention to provide a baseball swing training device that is operable to teach a player an angular swing plane of the bat during execution of a baseball swing.

Another object of the present invention is to provide a baseball swing training device that includes an upper frame assembly that is adjustable in a first direction and a second direction.

A further object of the present invention is to provide a baseball swing training device that is operable to teach an angular swing plane that further includes a base member.

Still another object of the present invention is to provide a baseball swing training device including a telescoping arm operably coupling the base member and the upper frame assembly.

Yet a further object of the present invention is to provide a baseball swing training device that is operable to teach an angular swing plane wherein the upper frame assembly further includes a first guide bar and a second guide bar that are parallel in manner having a space intermediate thereto.

An additional object of the present invention is to provide a baseball swing training device that is operable to teach an angular swing plane that includes a first ball gripping member and a second ball gripping member mounted intermediate the first guide bar and the second guide bar.

A further object of the present invention is to provide a baseball swing training device that is operable to teach an angular swing plane wherein the upper frame assembly is releasably secured so as to be reversibly mounted.

Another object of the present invention is to provide a baseball swing training device that further includes an angle mounting adapter operably coupled to the upper frame assembly that functions to provide angular adjustment positioning of the upper frame assembly.

Still a further object of the present invention is to provide a baseball swing training device operable to teach an angular swing plane that further includes the necessary electronics to record and display bat speed and ball speed.

To the accomplishment of the above and related objects the present invention may be embodied in the form illustrated in the accompanying drawings. Attention is called to the fact that the drawings are illustrative only. Variations are contemplated as being a part of the present invention.

BRIEF DESCRIPTION OF THE DRAWINGS

A more complete understanding of the present invention may be had by reference to the following Detailed Description when taken in conjunction with the accompanying Drawings wherein.

DETAILED DESCRIPTION

Figure 1:
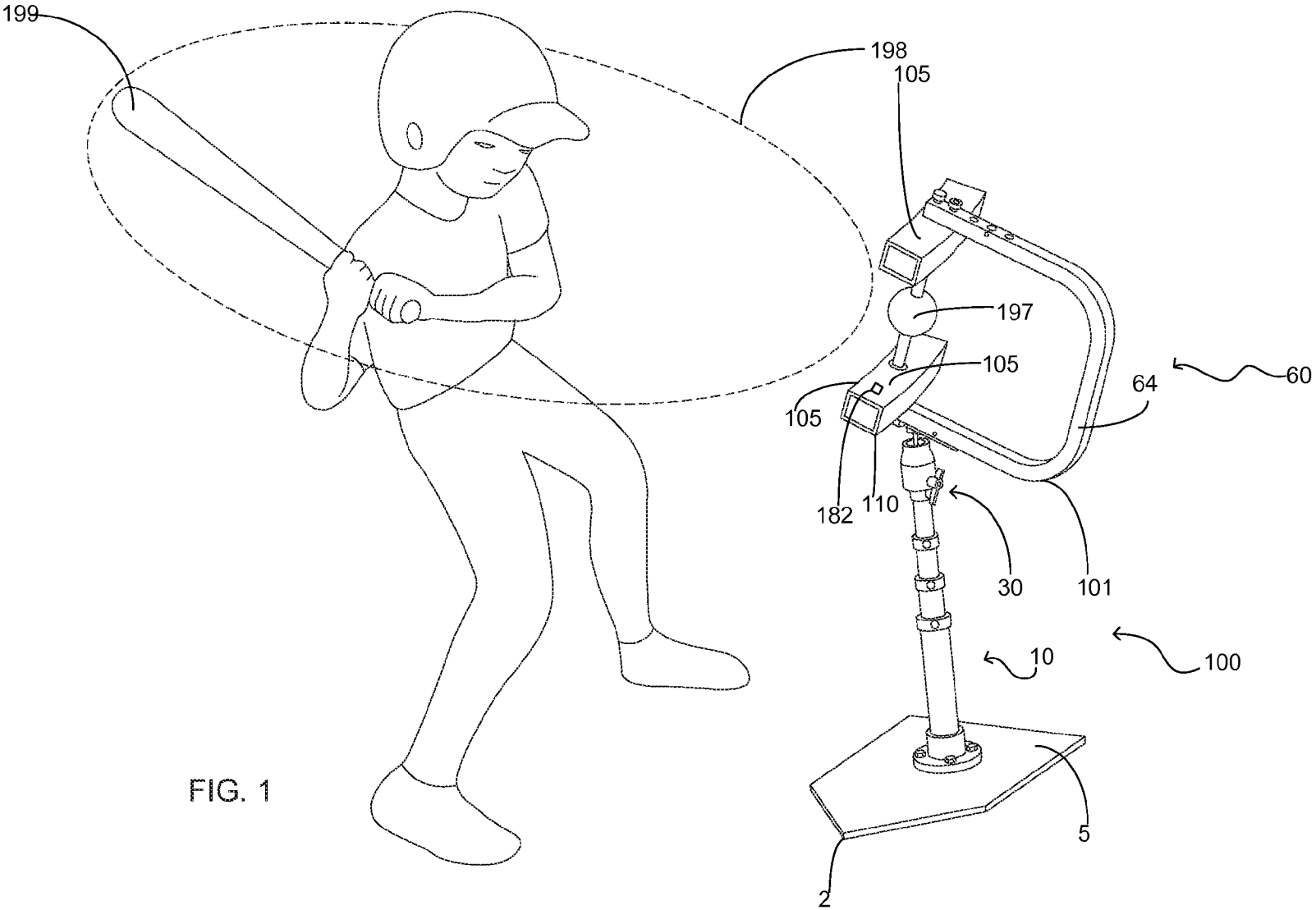
FIG. 1 is a perspective view of the present invention and an exemplary user.
Figure 2:
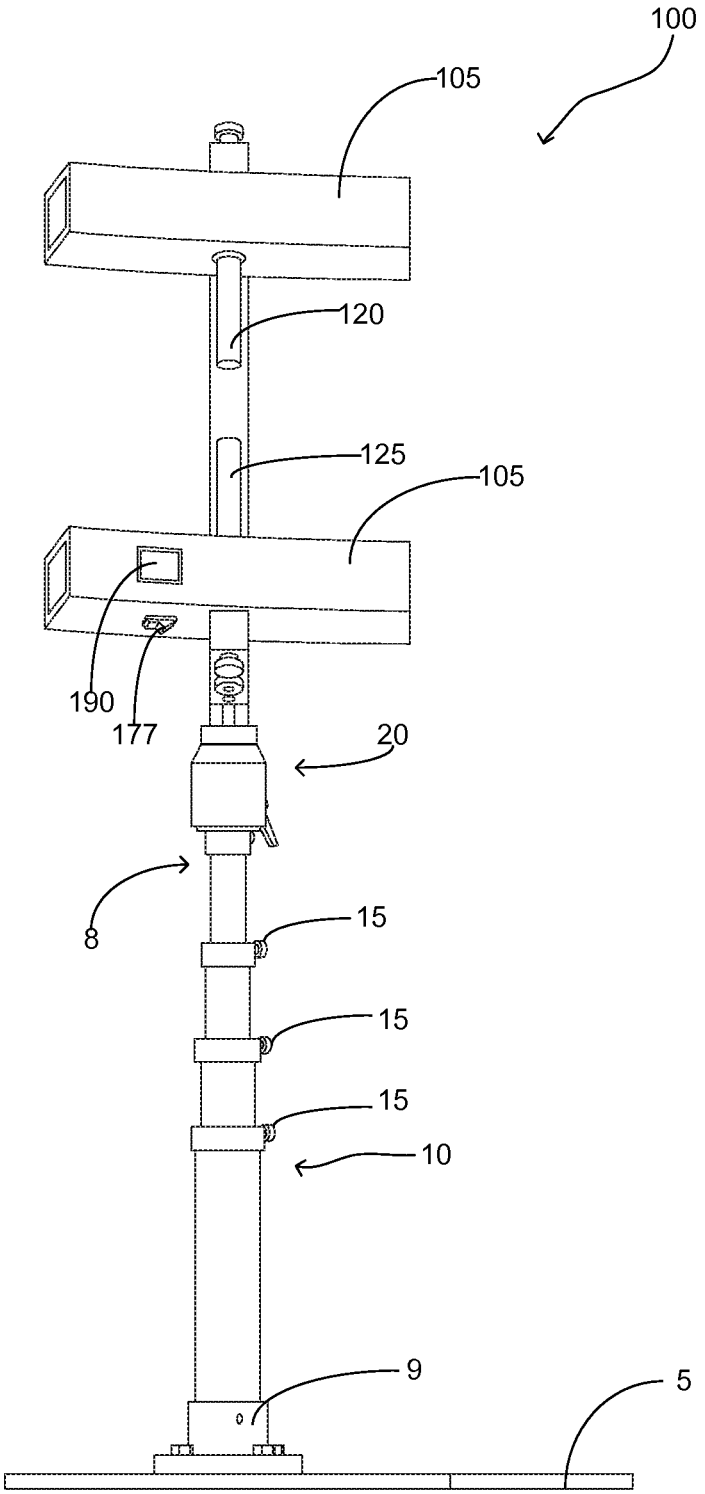
FIG. 2 is a front view of the present invention.
Figure 3:
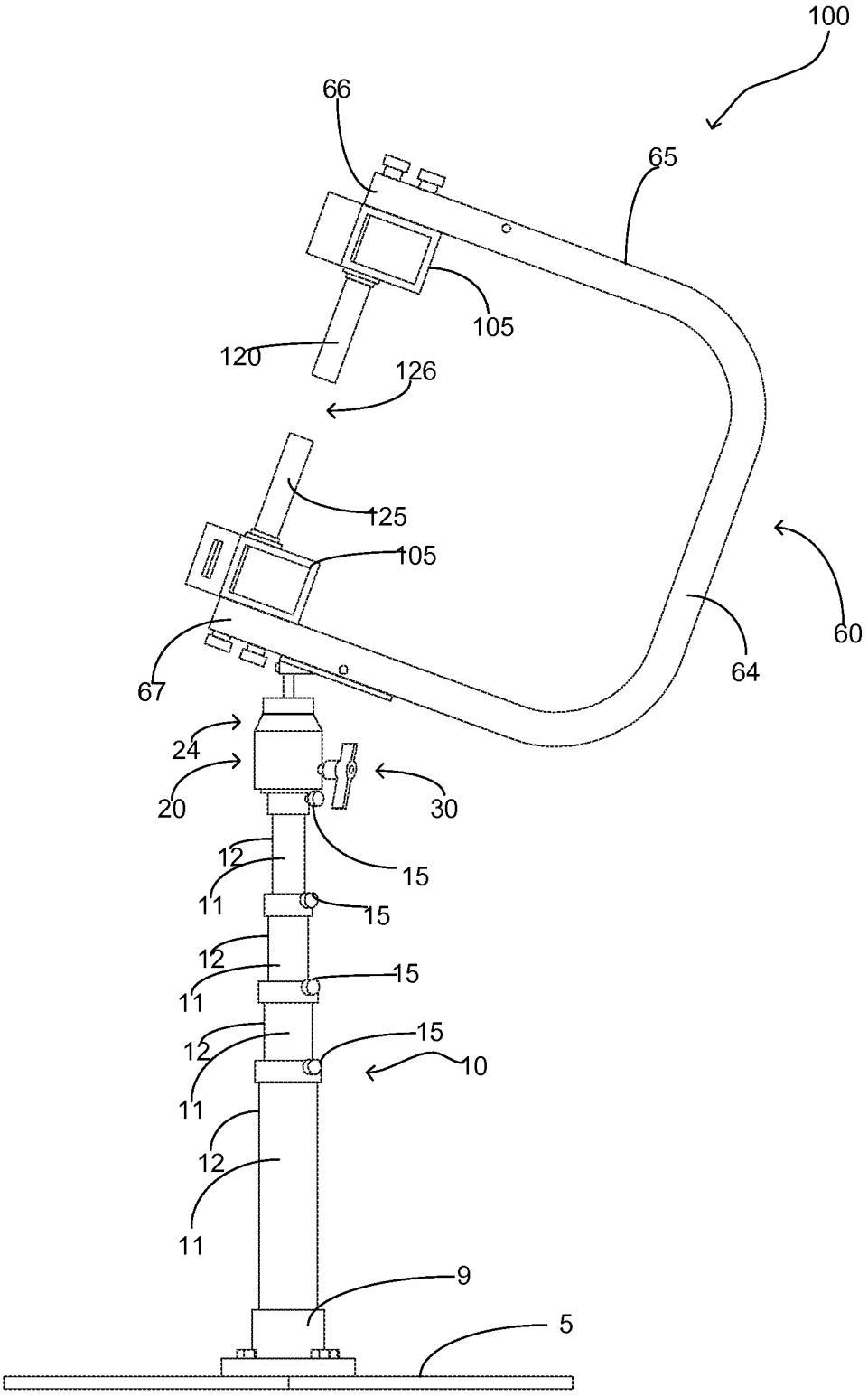
FIG. 3 is a right side view of the present invention.

Referring now to the drawings submitted herewith, wherein various elements depicted therein are not necessarily drawn to scale and wherein through the views and figures like elements are referenced with identical reference numerals, there is illustrated a swing training device 100 constructed according to the principles of the present invention.

Referring to the Figures herein the swing training device 100 further includes a base member 5. The base member 5 is generally planar in manner and is operable to provide stability for the swing training device 100 during use thereof. The base member 5 is manufactured from a suitable durable material such as but not limited to metal so as to provide sufficient weight for stabilizing the swing training device 100. Those skilled in the art will recognize that numerous different materials could be utilized to manufacture the base member 5. While the base member 5 is illustrated herein as being shaped similarly to the home plate of a baseball game, it is contemplated within the scope of the present invention that the base member 5 could be manufactured in numerous different shapes and accomplish the desired objective described herein. Secured to the upper surface 6 of the base member 5 is the telescoping support member 10. The telescoping support member 10 consists of a plurality of portions 11 that are slidably coupled with each adjacent portion 11. The telescoping support member 10 is secured to the upper surface 6 of the base member 5 with bracket 9. The portions 11 of the telescoping support member 10 are tubular in shape and substantially hollow and are manufactured from a suitable durable material such as but not limited to metal. A plurality of fasteners 15 are secured utilizing suitable techniques to the ends 12 of each portion 11. Each fastener 15 is operable to secure the portion 11 with which it is operable coupled at the desired height so as to provide the correct height for a user. While four portions 11 are illustrated herein, it is contemplated within the scope of the present invention that numerous different quantities of portions 11 could be included to comprise the telescoping support member 10. Furthermore, it is additionally contemplated within the scope of the present invention that the telescoping support member 10 could be manufactured using alternative techniques to operably control the height of the swing training device 100. More specifically but not by way of limitation, a corkscrew apparatus or other similar device could be utilized to control the height of the swing training device 100. It is further contemplated within the scope of the present invention that the telescoping support member 10 could be controlled by manual manipulation or with a conventional electric motor.

Secured to the second end 8 of the telescoping support member 10 is the mounting assembly 20. The mounting assembly 20 operably couples the upper frame assembly 60 with the telescoping support member 10. The mounting assembly 20 includes a housing 22 manufactured from a suitable durable material such as but not limited to metal. The housing 22 includes an opening 23 proximate the upper end 24 of the housing 20. The housing 22 is substantially hollow and includes a ball member 25 movably mounted therein. The ball member 25 is manufactured from a suitable durable material such as but not limited to metal and is superposed the support ring 27 within the interior volume of the housing 22. The ball member 25 facilitates the first and second axis adjustment of the upper frame assembly 60 as further discussed herein. A keeper 30 is mounted to the wall 29 of the housing 22 and includes a bolt 31 and handle 32. The bolt 31 is journaled through an aperture in the wall 29 of the housing 20 so as to be operably coupled with the ball member 25. The keeper 30 is operable to provide the setting of the position of the ball member 25, and thus the upper frame assembly 60, by applying a force thereto. Subsequent the upper frame assembly 60 being moved to the desired position, a user will engage the handle 32 so as to bias the bolt 31 against the ball member 25 so as to maintain the ball member 25 in a fixed position. While the mounting assembly 20 has been disclosed in its preferred embodiment herein, wherein the mounting assembly 20 includes a hollow housing 22 having a movable ball member 25 secured therein so as to facilitate the dual axis adjustment of the upper frame assembly 60, it is contemplated within the scope of the present invention that the mounting assembly could utilize numerous techniques and elements to accomplish the desired functionality of moving the upper frame assembly 60 along a first axis and a second axis.

Superposed the mounting assembly 20 is the angle guide member 40. The angle guide member 40 is generally annular in shape and is manufactured from a suitable durable material. The angle guide member 40 includes an inner portion 41 that is concave in shape. The concave inner portion 41 is operable to mateably receive a portion of the ball member 25 extending beyond the housing 22 and allow the movement thereof without interference. While not illustrated herein in particular, the angle guide member 40 has a concave inner portion 41 on both opposing sides. The angle guide member 40 is releasably secured to the mounting assembly 20 and is operable to be positioned in a first position and a second position thereon. In the second position the angle guide member 40 is flipped 180 degrees. This allows the angle guide member 40 to be utilized for both left and right handed users. The angle guide member 40 includes opposing holes 43,44 that are operable to receive conventional fasteners such as but not limited to screws so as to releasably secure the angle guide member 40 to the mounting assembly 20.

Figure 5:
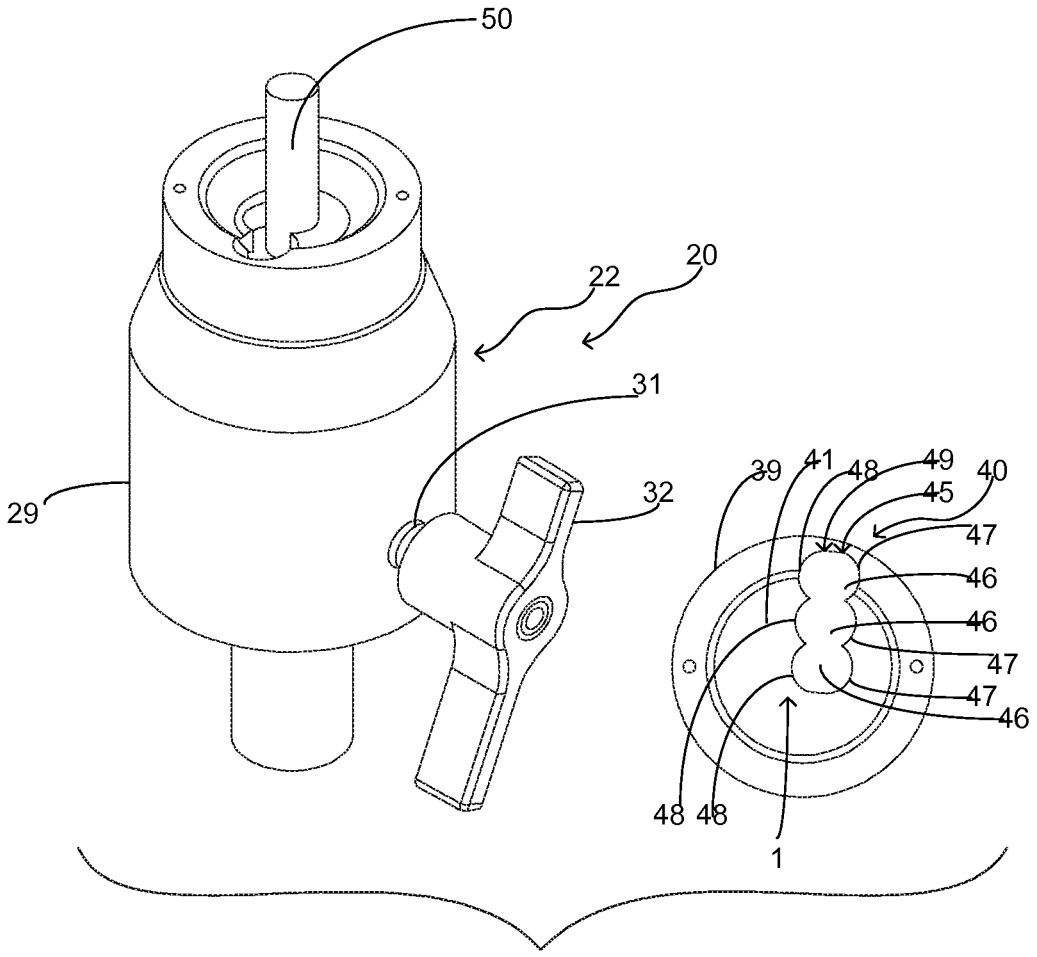
FIG. 5 is a detailed view of the mounting assembly of the present invention.

Referring in particular to FIG. 5, the angle guide member 40 further includes a plurality of adjustment apertures 45. The adjustment apertures 45 consist of three conjoined openings 46 that are generally annular in shape. The adjustment apertures 45 are operable to provide a plurality of fixed settings so as to position the support rod 50 in a desired manner so as to place upper frame assembly 60 in a desired position for use by different users having different skillsets. The adjustment apertures 45 extend from proximate the center of the angle guide member 40 to proximate the outer edge 39 thereof. The off center positioning of at least some of the openings 46 facilitate the positioning of the upper frame assembly 60 in its first axis as the support rod 50 is secured within the openings 46 away from the center 1 of the angle guide member 40. As the support rod 50 is secured within opening 46 more proximate the outer edge 39, the angle of tilt of the upper frame assembly 60 is greater. Each of the openings 46 further includes a first sidewall 47 and a second sidewall 48 on the opposing sides of each opening 46. The first sidewall 47 and second sidewall 48 are angular in manner with the first sidewall 47 and second sidewall 48 of each opening 46 having different angles. By way of example but not limitation, the first opening 49 could be manufactured such that the first sidewall 47 has an angle of approximately six degrees and the second sidewall 48 is manufactured at an angle of approximately fifteen degrees. The aforementioned example positions the upper frame assembly 60 such that the upper frame assembly 60 is tilted away from a user (first axis of movement, shown in particular in FIG. 1, wherein the corner 101 has been moved to be more proximate the base member 5) and tilted in a rearward manner, i.e., the end 110 of the bat guide members 105 are angled towards the apex 2 of the base member 5 thus providing the tiltable adjustments needed to place the exemplary ball 197 in position to teach a desired exemplary swing plane 198.

Each opening 46 of the adjustment apertures 45 have a different angle for the first sidewall 47 and the second sidewall 48. The different angles of the first sidewall 47 and the second sidewall 48 provide a plurality of fixed settings for the support rod 50 so as to provide a multitude of easy to manipulate adjustments of the upper frame assembly 60. While no particular range of angles for the first sidewall 47 and second sidewall are required, good results have been achieved utilizing an angle range of zero to thirty degrees. This allows a user to quickly position the upper frame assembly 60 wherein the first axis position and the second axis position of the upper frame assembly 60 are controlled by which opening 46 the support rod 50 is secured thereinto. While the adjustment apertures 45 have been illustrated herein as having three openings 46, it is contemplated within the scope of the present invention that the adjustment apertures 45 could be comprised of numerous different amounts of openings 46 to provide a multitude of positions for the support rod 50. Additionally, it is within the scope of the present invention that the swing training device 100 could be utilized without the angle guide member 40 and the user could adjust the upper frame assembly 60 to a desired position utilizing the ball member 25 and secure with the keeper 30.

Figure 4:
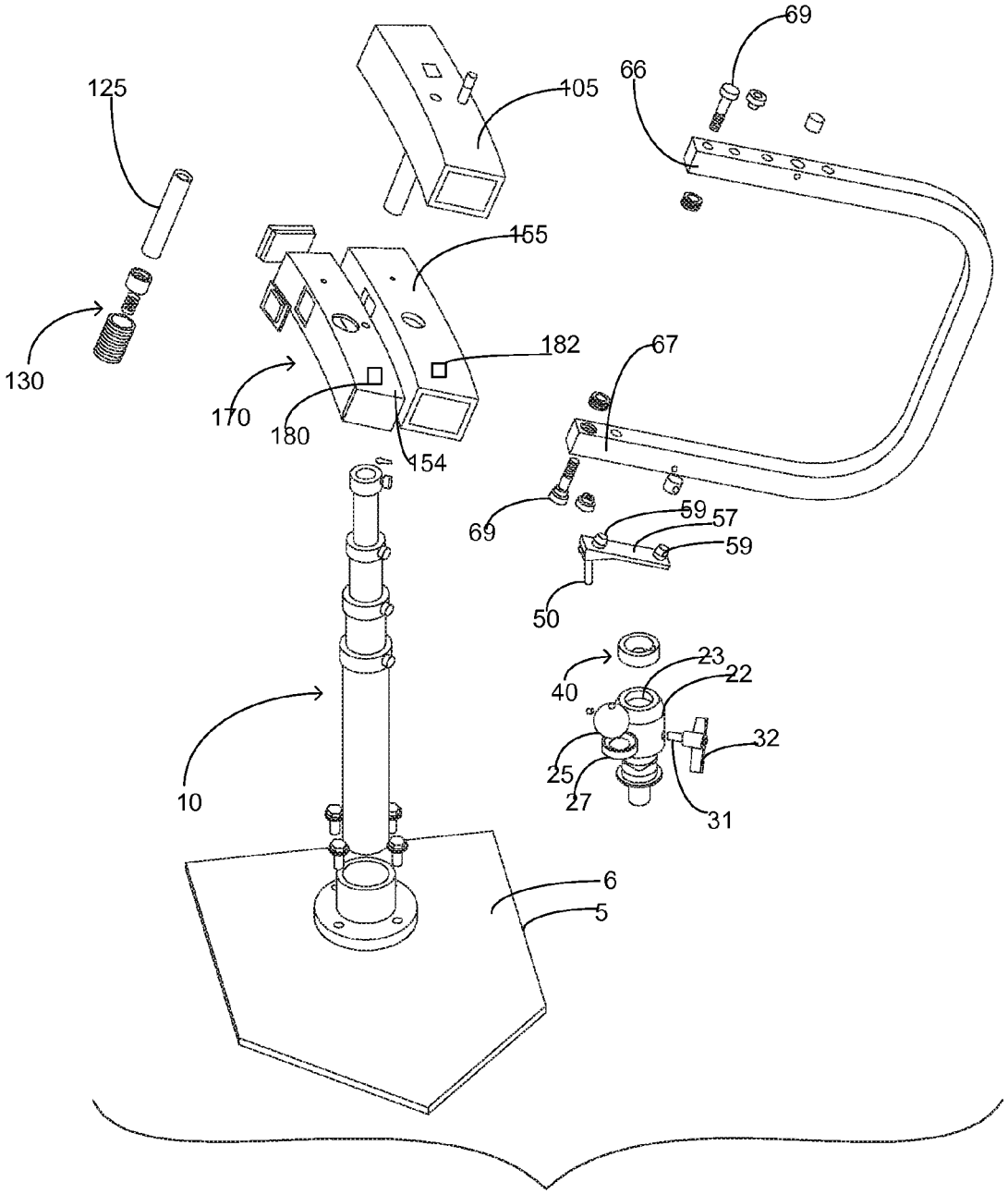
FIG. 4 is an exploded view of the present invention.

Referring in particular to FIG. 4, the support rod 50 is operably coupled to the ball member 25 and the connection plate 57. The support rod 50 is secured to the ball member 25 and connection plate 57 utilizing suitable durable techniques such as but not limited to welding. The support rod 50 is secured to the connection plate 57 in an angular manner. The angular mounting of the support rod 50 to the connection plate 57 provides a bias towards the desired first axis angle of the upper frame assembly 60. Additionally, utilizing an angular mounting of the support rod 50 to the connection plate 57 provides additional structural stability, as the ball member 25 movement required is less creating an improved center of gravity for the swing training device 100. While no particular angle is required for mounting the support rod 50 to the connection plate 57, good results have been achieved utilizing an angle of approximately twenty degrees from perpendicular. The upper frame assembly 60 is secured to the connection plate utilizing suitable mechanical fasteners 59.

The upper frame assembly 60 consists of support arm 65 that is generally u-shaped and rigid in manner being constructed from a suitable durable material such as but not limited to square metal tubing having been bent to form the shape illustrated herein. While no particular length of the support arm 65 is required, it is desirable that a sufficient length of metal tubing be utilized so as to allow sufficient space between the bat guide members 105 and the rear portion 64 so as to promote clearance for a an exemplary bat 199 during use of the swing training device 100. Secured to the ends 66,67 of the support arm 65 are the bat guide members 105. The bat guide members 105 are secured using fasteners 69. The bat guide members 105 are manufactured from a suitable durable material such as but not limited to rectangular metal tubing. The bat guide members 105 are arcuate in shape so as to align with the portion of the exemplary swing plane and rotation as the exemplary bat 199 is passed therethough. While no particular radius is required, good results have been achieved utilizing a radius of approximately thirty-six inches for the bat guide members 105.

Mounted intermediate the bat guide members 105 are an upper ball grip member 120 and a lower ball grip member 125. The upper ball grip member 120 and lower ball grip member 125 are perpendicular with the bat guide members 105 and extend towards each other having a gap 126 present therebetween. The upper ball grip member 120 and lower ball grip member 125 are manufactured from a resilient durable material such as but not limited to rubber so as to avoid damaging the exemplary bat 199 if contact should occur. The upper ball grip member 120 and lower ball grip member 125 are mounted utilizing a spring assembly 130. The spring assembly 130 permits movement of the upper ball grip member 120 and lower ball grip member 125 during hitting of the ball facilitating the release of the exemplary ball 197. The spring assembly 130 is operable to provide a bias against the exemplary ball 197 subsequent the exemplary ball 197 being mounted intermediate the upper ball grip member 120 and the lower ball grip member 125. Utilization of the spring assembly 130 promotes a slight upward-downward movement of the lower ball grip member 125 and the upper ball grip member 120, which facilitates the initial positioning of the exemplary ball 197 therebetween. This bias force facilitates the maintenance of the exemplary ball 197 in position intermediate the lower ball grip member 125 and upper ball grip member 120 as the upper frame assembly 60 is tilted in its first and second directions. Those skilled in the art will recognize that the upper ball grip member 120 and the lower ball grip member 125 could be mounted utilizing numerous suitable fasteners in order to achieve the desired functionality herein.

Disposed within the lower bat guide member 155 (illustrated external thereto in FIG. 4 for discussion purposes) is the electronics assembly 170. The electronics assembly 170 contains the required electronic components to store, receive, manipulate, measure and transmit data. The electronics assembly 170 is utilized to record and display metrics such as but not limited to bat speed and ball speed. A sensor 180 is located proximate end 154 and is in alignment with aperture 182. The sensor 180 is operable to measure the speed of the exemplary bat 199 as it passes thereby. The bat speed is transmitted and displayed to a user via a conventional LCD screen 190. It is contemplated within the scope of the present invention that the sensor 180 could utilize numerous existing technologies such as photo sensor or motion radar to detect the speed of the exemplary bat 199. It is further contemplated within the scope of the present invention that the upper frame assembly 60 could be reversibly mounted such that the lower bat guide 155 would be positioned opposite as illustrated herein. This would place the sensor 180 forward of the exemplary ball 197 and would thus be operable to detect and display ball speed. It is further contemplated within the scope of the present invention that the lower bat guide 155 could include a plurality of sensors so as to record both bat speed and ball speed. Additionally, it is contemplated within the scope of the present invention that the sensor 180 could be placed in numerous positions on the upper frame assembly 60 so as to measure either bat or ball speed. The electronics assembly 170 further includes a self-contained power source such as but not limited to a replaceable battery and is activated utilizing the power switch 177.

Referring to FIG. 1 herein, a description of the operation of the swing training device 100 is as follows. In use, a user will adjust the telescoping support member 10 to the desired height and place an exemplary ball 197 in the gap 126 intermediate the upper ball grip member 126 and lower ball grip member 127 wherein the exemplary ball is biased therebetween. The user will adjust the force on the keeper 30 so as to loosen the force applied to the ball member 25 in order to move the upper frame assembly 60 to the desired position. The user will then adjust the upper frame assembly 60 in a first direction such that the upper frame assembly is tilted generally away from the user. Ensuing the first direction adjustment, the user will then adjust the upper frame assembly 60 in a second direction such that the upper frame assembly 60 is tilted in a general rearward direction and previously discussed herein. The angle guide member 40 provides preset positioning for the first direction adjustment and the second direction adjustment as discussed herein or the user could utilize the swing training device 100 without the angle guide member 40 and facilitate their own adjustments. Subsequent the desired positioning, the keeper 30 is secured so as to maintain the set position and the swing training device 100 is ready for use by a user. Additionally, if desired, the user may activate the electronics assembly 170 via the power switch 177 so as to receive feedback on either ball speed or bat speed.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A baseball swing training device operable to teach a desired swing plane for hitting a baseball comprising:

a base member, said base member having an upper surface and a lower surface, said base member being generally planar, said base member having a front edge and a rear edge;

a support pole, said support pole being secured to said upper surface of said base member and extending upward therefrom and being perpendicular thereto, said support pole further including a plurality of telescoping segments, said support pole being adjustable in length;

a mounting assembly, said mounting assembly being superposed said support pole opposite said base member, said mounting assembly further including a housing, said housing having a vertical wall forming a cylindrical shape, said housing having an upper end and a lower end, said housing having a first opening proximate said upper end, said housing having a second opening at said lower end, said mounting assembly having an interior volume, said mounting assembly having a ball member movably mounted within said interior volume of said housing, said ball member being operably coupled to said upper frame assembly;

an upper frame assembly, said upper frame assembly being operably coupled to said mounting assembly, said upper frame assembly configured to releasably secure a baseball;

a connection assembly, said connection assembly further including a connection plate, said connection plate being planar in manner having a first end and a second end, said connection plate having an upper surface and a lower surface, said connection assembly further including a support rod, said support rod having a first end and a second end, said support rod being secured to said lower surface of said connection plate proximate said second end, said second end of said support rod being secured to said ball member, said support rod extending upward through said first opening of said housing, said support rod being angularly secured to said connection plate;

wherein said upper frame assembly is tiltably adjustable in a first axial direction and a second axial direction so as to place a baseball secured therein in a position for teaching a desired hitting swing plane.

2. The baseball swing training device as recited in claim 1, and further including an angle guide positioning member, said angle guide positioning member being superposed said housing of said mounting assembly, said angle guide positioning member having a plurality of conjoined adjacent holes therein, said plurality of conjoined adjacent holes having a first side wall and a second side wall being oppositely located, said first side wall and said second sidewall being angular in manner, said first side wall and said second side wall being manufactured to have an angle between zero and thirty degrees.

3. The baseball swing training device as recited in claim 2, wherein said upper frame assembly further includes a support arm, said support arm having a first end and a second end, said support arm being generally u-shaped, said support arm being operably coupled to said connection plate.

4. The baseball swing training device as recited in claim 3, and further including an upper bat guide member and a lower bat guide member, said upper bat guide member being secured to said first end of said support arm, said lower bat guide member being secured to said second end of said support arm, said upper bat guide member and said lower bat guide member being parallel in configuration having a space intermediate thereto.

5. The baseball swing training device as recited in claim 4, wherein in said first axial direction said upper frame assembly is tilted away from a user and in said second axial direction said upper frame assembly is tilted towards said rear edge of said base member.

6. A baseball swing training device that is operable to teach a desired swing plane for effectively hitting a baseball comprising:

a base member, said base member having an upper surface and a lower surface, said base member being generally planar, said base plate having a front edge and a rear edge;

a support pole, said support pole being secured to said upper surface of said base member and extending upward therefrom and being perpendicular thereto, said support pole further including a plurality of telescoping segments, said support pole being adjustable in length;

a mounting assembly, said mounting assembly being superposed said support pole opposite said base member, said mounting assembly further including a housing, said housing having an interior volume, said housing having a vertical wall forming a cylindrical shape, said housing having an upper end and a lower end, said housing having a first opening proximate said upper end, said housing having a second opening at said lower end, said mounting assembly having a ball member movably mounted within said interior volume of said housing;

a connection assembly, said connection assembly further including a connection plate, said connection plate being planar in manner having a first end and a second end, said connection plate having an upper surface and a lower surface, said connection assembly further including a support rod, said support rod having a first end and a second end, said support rod being secured to said lower surface of said connection plate proximate said second end, said second end of said support rod being secured to said ball member, said support rod extending upward through said first opening of said housing, said support rod being angularly secured to said connection plate an upper frame assembly, said upper frame assembly being operably coupled to said connection plate of said mounting assembly, said upper frame assembly further including a support arm, said support arm having a first end and a second end, said support arm being u-shaped, said support arm being oriented wherein said first end and said second end are in vertical alignment, said upper frame assembly further including an upper bat guide member and a lower bat guide member, said upper bat guide member being secured proximate said first end of said support arm and being perpendicular thereto, said lower bat guide member being secured to said support arm proximate said second end and being perpendicular thereto, said lower bat guide member and said upper bat guide member being parallel having a space intermediate thereto;

an angle guide positioning member, said angle guide positioning member being annular in shape having an upper surface and a lower surface, said upper surface and said lower surface being concave in shape, said angle guide positioning member being superposed said housing of said mounting assembly, said angle guide positioning member having a plurality of conjoined adjacent holes therein, said connection rod extending upward through said plurality of conjoined adjacent holes, said angle guide member operable to assist in the tiltable positioning of the upper frame assembly; and wherein said upper frame assembly is tiltably adjustable in a first axial direction and a second axial direction, wherein said upper frame assembly is tilted away from a user in said first axial direction and wherein said upper frame assembly is tilted in said second axial direction such that the second axial direction is perpendicular to said first axial direction.

7. The baseball swing training device as recited in claim 6, wherein said connection rod is secured to said connection plate at an angle of approximately twenty degrees.

8. The baseball swing training device as recited in claim 7, and further including a first ball grip member and a second ball grip member, said first ball grip member being secured to said lower bat guide member and extending upward therefrom, said second ball grip member being secured to said upper bat guide member and extending downward therefrom, said first ball grip member and said second ball grip member being in general axial alignment, said first ball grip member and said second ball grip member operable to releasably secure a ball intermediate thereto, wherein said first ball grip member and said second ball grip member are secured within said lower bat guide member and said upper bat guide member with spring assemblies so as to promote a biased force against a ball mounted intermediate said first ball grip member and said second ball grip member.

9. The baseball swing training device as recited in claim 8, and further including a speed sensor, said speed sensor being disposed in said upper frame assembly, said speed sensor operable to detect speed of a bat passing in between said lower bat guide member and said upper bat guide member and further being operable to detect the speed of a ball being released from said upper frame assembly.

10. The baseball swing training device as recited in claim 9, wherein said plurality of conjoined adjacent holes of said angle guide positioning member have a first side wall and a second side wall being oppositely located, said first side wall and said second sidewall being angular in manner, said first side wall and said second side wall being manufactured to have an angle between zero and thirty degrees.

* * * * *